United States Patent [19]

Hough

[11] 4,438,565

[45] Mar. 27, 1984

[54] HANDLE FOR A HAND TOOL

[75] Inventor: John A. Hough, Auckland, New Zealand

[73] Assignee: Hough Industries Limited, Auckland, New Zealand

[21] Appl. No.: 160,484

[22] Filed: Jun. 18, 1980

[30] Foreign Application Priority Data

Jun. 20, 1979 [NZ] New Zealand ..... 190779

[51] Int. Cl.[3] ..... B25G 1/00

[52] U.S. Cl. ..... 30/341

[58] Field of Search ..... 30/341, 340, 124

[56] References Cited

U.S. PATENT DOCUMENTS

| | | | |
|---|---|---|---|
| 404,667 | 6/1889 | Woodhouse et al. | 30/341 |
| 409,097 | 8/1889 | Casey | 30/341 |
| 419,111 | 1/1890 | Casey | 30/341 |
| 486,083 | 11/1892 | Clark | 30/341 |
| 923,734 | 6/1909 | Tindall | 30/341 |
| 1,503,536 | 8/1924 | Klauke | 30/341 |
| 1,702,226 | 2/1929 | Bruninghaus | 30/341 |
| 2,769,237 | 11/1956 | Oxhandler | 30/341 |
| 2,941,294 | 6/1960 | Vosbikian et al. | 30/340 |
| 3,842,500 | 10/1974 | Cassel | 30/124 |

FOREIGN PATENT DOCUMENTS

| | | | |
|---|---|---|---|
| 570155 | 6/1945 | United Kingdom | 30/341 |

*Primary Examiner*—Frederick R. Schmidt
*Assistant Examiner*—J. T. Zatarga
*Attorney, Agent, or Firm*—Holman & Stern

[57] ABSTRACT

A handle for a hand tool comprises a shank, a sheath, and an intermediate member which fits between the shank and the sheath. The intermediate member fills the space between the shank and the sheath, to allow the sheath to be moulded to any desired external shape and yet have uniform wall thickness, and still be securely held to the shank.

14 Claims, 5 Drawing Figures

HANDLE FOR A HAND TOOL

BACKGROUND OF THE INVENTION

This invention relates to a handle for a hand tool.

In the past, such handles have commonly been made of a plastic sheath which has been moulded to fit around a steel shank. Problems have arisen with such handles in that where their wall thickness is non-uniform, shrinkage during moulding and curing is a problem. This has been overcome to some extent by use of expensive acrylonitrile-butadiene-styrene plastic resins. Even so, precise moulding procedures were still necessary. It was found, for example that increasing the moulding time from 45 seconds to 46 meant that the handles fell off whereas at 45 seconds they stayed on.

Another disadvantage with such handles is that there is no visual indicator to indicate when the handles are properly secured to the metal shank, and the only way to tell when the handles are on is to try and get them off again. While the handles are being jammed on, stress marks, appearing as a white discolouration of the plastic, can be created which give the handles an unsightly appearance.

The object of the present invention is to provide a shank over which a plastic sheath of uniform wall thickness may be placed and which may provide a clear visual indication of when the sheath has been properly located on the shank to form the handle.

SUMMARY OF THE INVENTION

In a first aspect, the present invention consists of an improved handle for a hand tool comprising an infill member adapted to interlock with the shank of the tool and a sheath of uniform wall thickness adapted to enclose the shank and infill member and to be fixed to either.

DESCRIPTION OF THE PREFERRED EMBODIMENT

Figure 1:
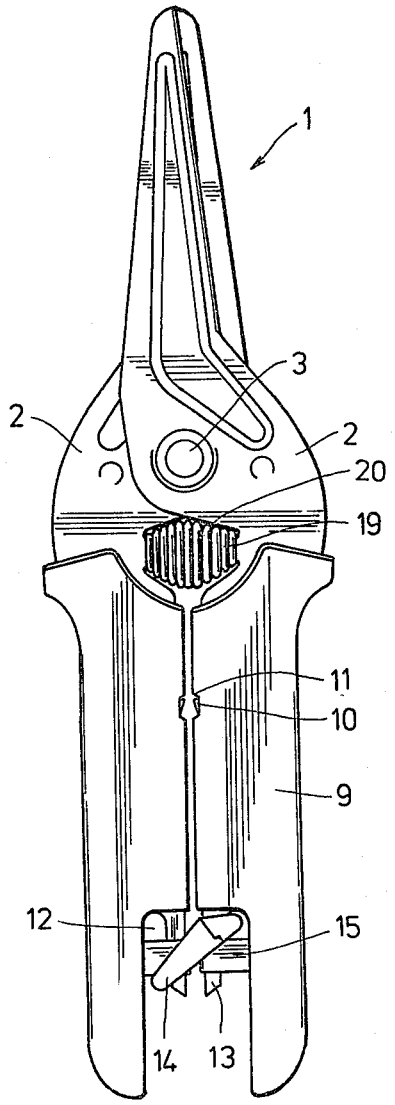
FIG. 1 is a view of a scissor-like tool with handles according to the present invention.
Figure 2:
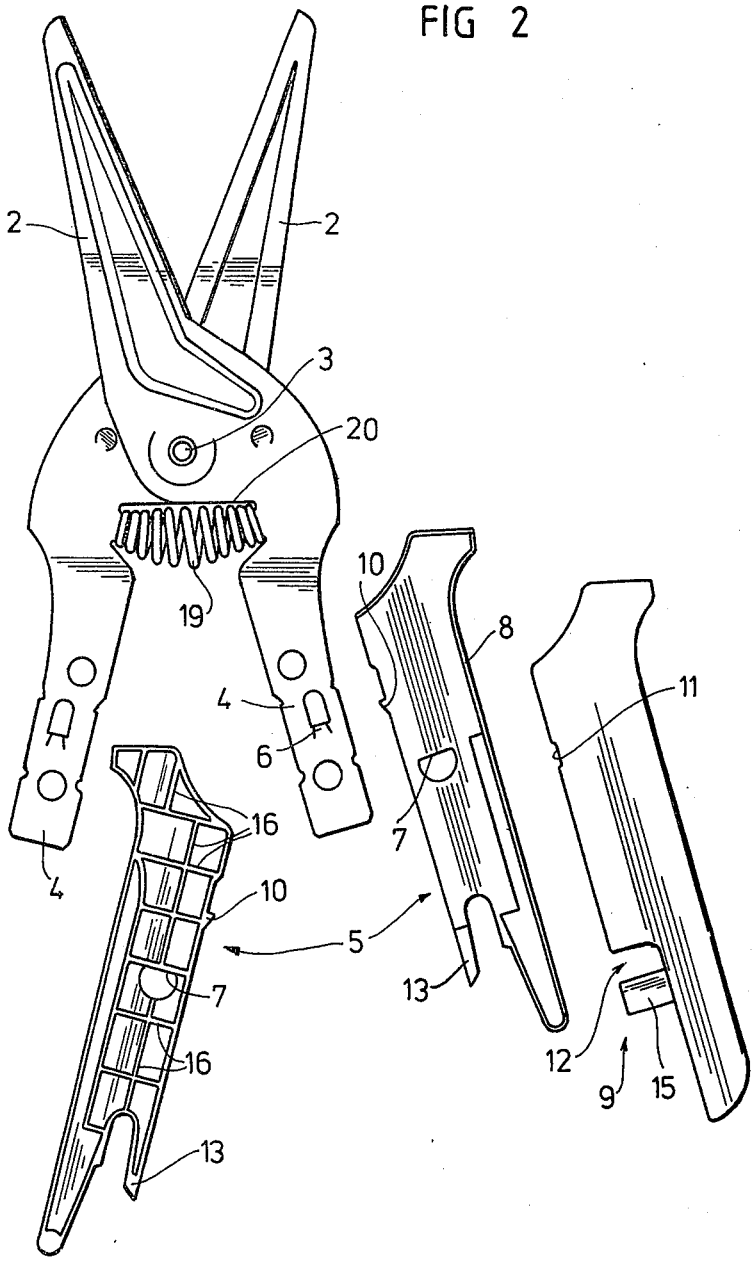
FIG. 2 is a partial exploded diagram of the tool shown in FIG. 1 showing both sides of an infill member and a sheath.

In the preferred form of the invention as shown in FIGS. 1 and 2 a pair of hand cutters 1 is provided with two metal blades 2 which are pivoted together about a central point 3. The handle end 4 of each blade is shaped to mate securely with a plastics insert, or infill member, 5, typically of polypropylene. The tip of the tang 4 can be fitted into a recess in the insert 5 and then the flat side of the blade is pushed into the insert so that a tang ramp 6 in the blade is snap fitted over a corresponding abutment surface 7 of a D-shaped aperture in the insert to hold the two securely together. The tang ramp 6 thus provides a visual indication as to when the insert is properly located on the tang 4.

The insert thus becomes effectively an extension of the blade, and is so shaped that a sheath placed over the insert and blade assembly, to form a handle, may be of uniform thickness. The insert is structurally designed to provide the necessary strength to transmit forces from the handle to the blade. Typically, the insert has a ridge 8 along each side, so that the insert is in the form of an I-beam, while the sheath is in the form of a box-section around it.

The sheath 9, which forms the visible part of the handle, may also be moulded of polypropylene and then is merely slid over the blade and insert assembly so that an infill ramp 10 on the insert engages a corresponding abutment 11 in the sheath. If the insert 5 and sheath 9 are made of different coloured materials, it is very easy to tell whether the sheath is properly in position simply by seeing whether the stud (infill ramp 10) is, in fact, in the aperture (of abutment 11). In another embodiment, there may be a stud extending from each side of the infill member and a corresponding aperture on each side of the sheath.

Either tang ramp 6 or infill ramp 10 may be made readily compressible so that the sheath or insert can be withdrawn again from the handle if desired.

At the inside edge of the handle there is a recess 12. The insert has a long thin extension 13 which extends across the recess, so that when the sheath is slid onto the handle and insert assembly the extension extends across the recess and forms an eye through which a clip 14 or other appendage can be attached to the handle. The clip may be held by this eye on one handle and it may then be easily slipped over a similar narrow extension of the insert of the other handle, the end of which either does not meet the end of the recess of the sheath of that handle, or extends beyond a protrusion 15 which forms the edge of the recess 12 as shown in FIGS. 1 and 2.

Ribs 16 may be provided on the insert to divide the hollow space between the insert and the sheath into a plurality of cell and thus to inhibit moisture from entering the space. Even if water does get in, it will not readily splash about within the handle, as it will be confined to a single space, or cell, between the ribs. Moisture entering the handle is therefore not likely to present a problem.

In the embodiment of FIGS. 1 and 2 the two handles are held apart by a compression spring 19 positioned between the tangs near their bases.

In order to fit the insert over the tang and spring the end of the insert should be bell mouthed so that the space between the end web and the opposite wall of the insert is able to fit over the thickest portion of the tang and spring assembly. The spread-apart sides of the end of the insert will however be compressed together when the sheath is placed over the insert so that the end web of the insert if pressed down against the material of the tang thus closing off the interior of the insert.

Preferably the tang is provided with an abutment against which the insert rests when the insert has been pushed properly onto the tang, thus preventing the insert from being pushed too far onto the tang. Without such an abutment the insert is likely to be pushed further on to the tang as the sheath is being pushed onto the insert.

Preferably the insert hugs the tang along its full length, but the sheath may contact the insert only at each end, there being a space between the tapered insert and the contoured sheath between the points at which the sheath grips the insert.

Figure 3:
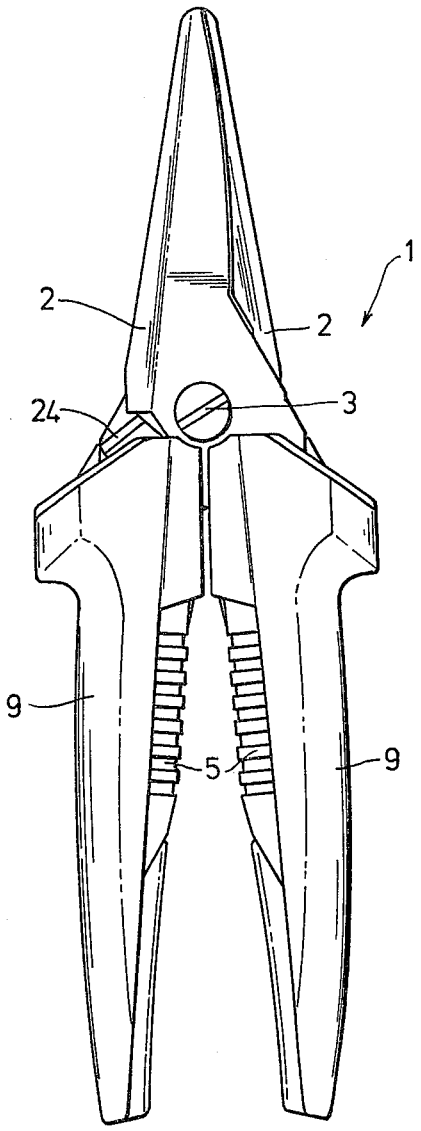
FIG. 3 is a view of a second scissor-like tool with handles according to the present invention.
Figure 4:
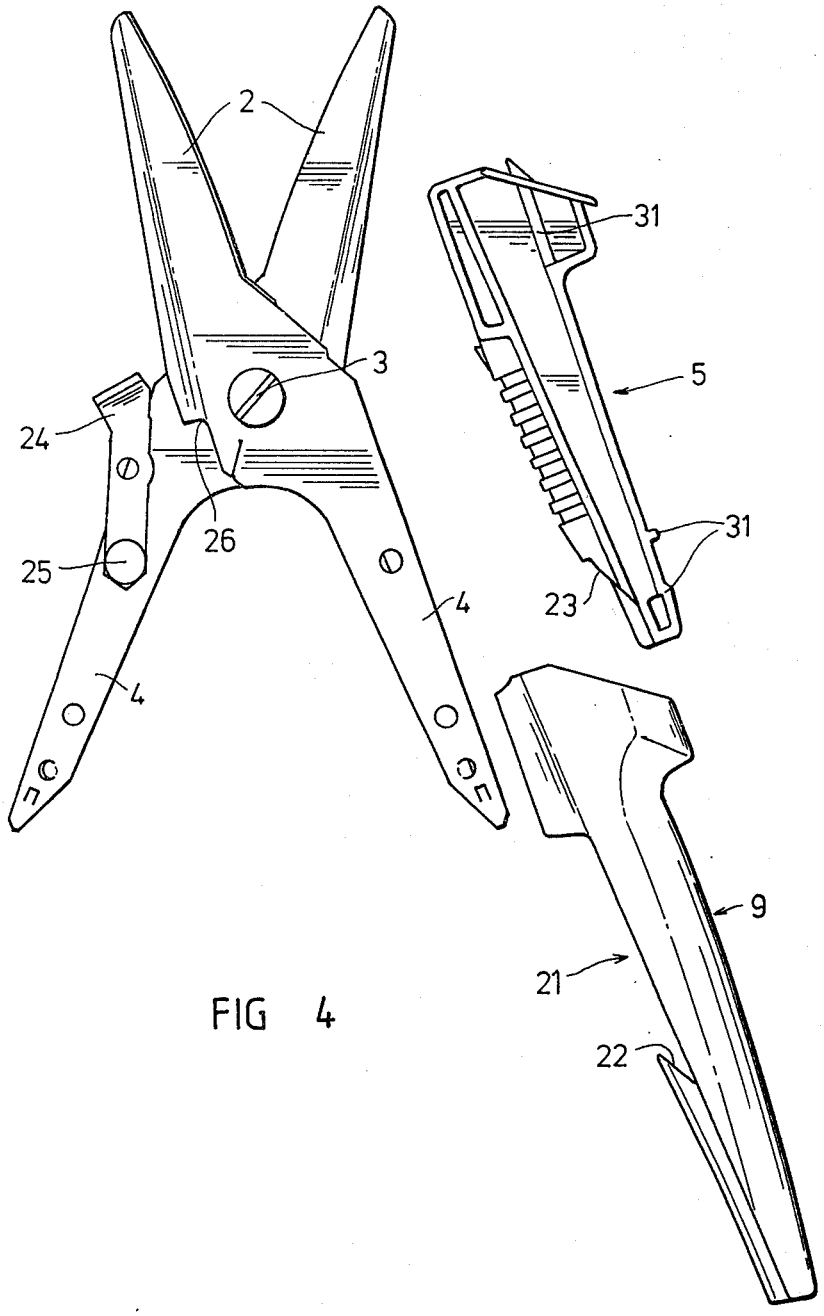
FIG. 4 is a partial exploded diagram of the tool shown in FIG. 3 showing an infill member and a sheath.
Figure 5:
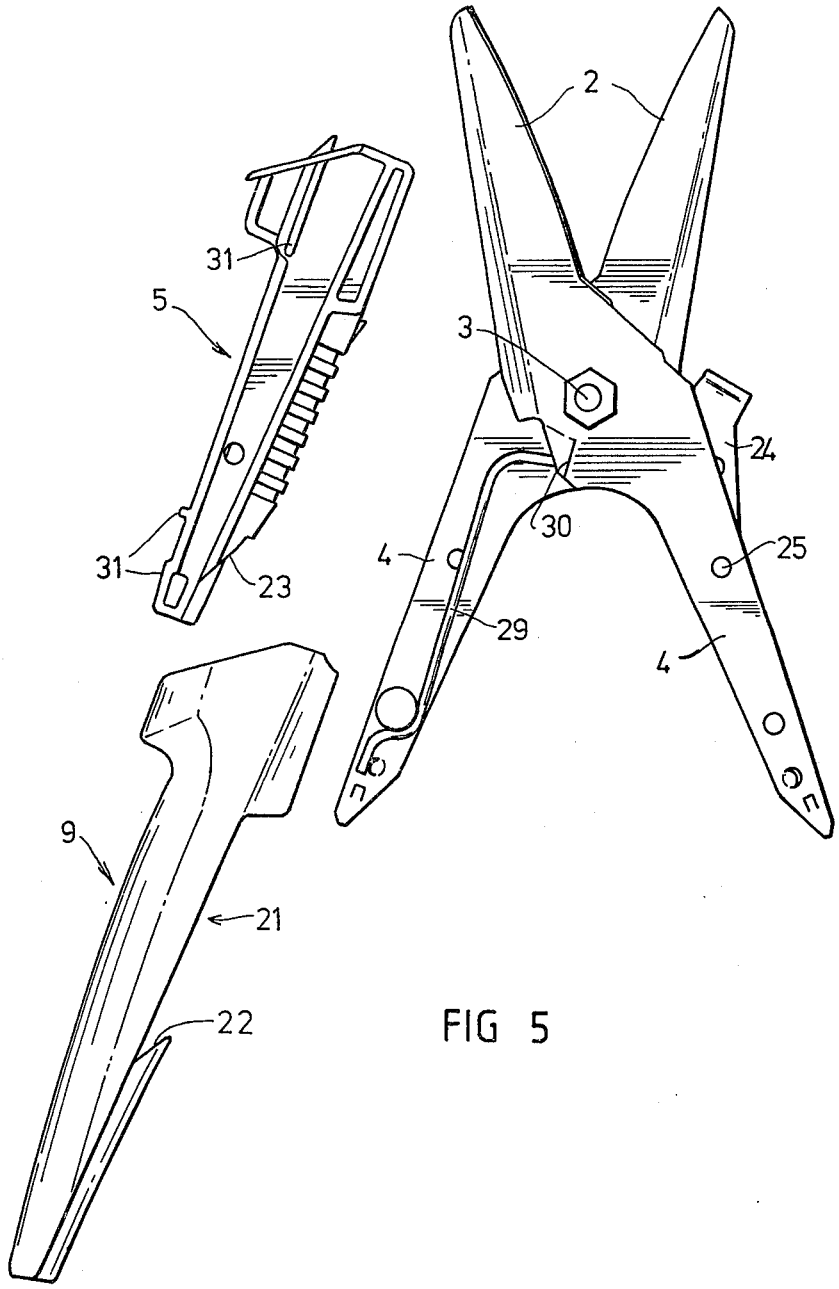
FIG. 5 is a view from the opposite side of the tool shown in FIG. 3.

The second embodiment shown in FIGS. 3 to 5 is in many respects similar to that of FIGS. 1 and 2, and corresponding parts have been given the same reference numerals.

In this second embodiment there is no ramp 10, abutment 11, or extension 13. In this case the sheath 9 has a large aperture 21 with a shaped end surface 22 which engages a sloped portion 23 of the insert (infill member) 5.

Instead of a clip 14 there is a clip member 24 pivoted at 25 to the tang 4. The clip is pivotable within a recess within the insert 5 between a first position in which it engages an abutment 26 on the blade and a second position in which the clip member is out to the side, clear of the abuttment 26, so that the blade is free to pivot about the pivot point 3.

Instead of a coil spring 19 there is a leaf spring 29 within the handle, fixed to the tang as shown. The spring bears against an abutment 30 of the opposite blade to urge the tool towards its open position.

The insert is, of course, wide enough in its interior to accommodate the thickness of the tang and either the clip member 24 or the spring 29. The interior of the insert is typically shaped to provide a guide to hold the tang securely against one side of the insert so that the tang cannot flap about within the insert.

The external surface of the insert may be provided with projections (studs) 31 so that the sheath grips the insert securely only over the projections, which are preferably at each end of the handle.

The invention is, of course, equally applicable to hand tools, such as garden trowels, which have only a single handle, except that in such cases the appendage 14, if provided, will not be a clip but a hook or loop whereby the tool can be hung up.

The construction of handles provided by the present invention has the advantage that it enables use of a good finish to a handle without the use of an expensive grade of plastic material, since it enables a plastic handle to be of uniform wall thickness, which is much easier to mould than one of varying wall thickness shaped to fit the steel core of the handle. It also enables the steel portion of the handle to be pressed from a smaller piece of steel, thus resulting in less wastage in the form of offcuts. Thus, despite the fact that this construction has an additional member as compared with prior construction of handles, it is cheaper to produce, and lighter in weight. It also provides a simpler means of ensuring that the handle has been properly assembled.

What we claim is:

1. In a hand tool having at least one shank and attached handle, the improvement comprising:

an infill member enclosing and having means to interlock with the shank, and a sheath of uniform thickness having a recess and enclosing both the shank and the interlocked infill member and having means to be fixed to either, wherein said infill member has a narrow portion at one end, parallel to the longitudinal axis of the handle, which extends across the recess in the sheath to provide an eye through which an attachment means may pass in order to be pivotally attached to the handle.

2. The improvement of claim 1 wherein a stud is provided protruding from the surface of the shank and the sheath has an aperture for engaging said stud.

3. The improvement of claim 1 wherein a stud is provided protruding from the surface of the infill member and the sheath has an aperture for engaging said stud.

4. The improvement of claim 3 wherein a stud protrudes from each side of the infill member and the sheath has corresponding apertures on each side for engaging said studs.

5. The improvement of claim 1 wherein the tool has two shanks and a handle mounted upon each shank.

6. The improvement of claim 4 wherein the upper surface of each stud is sloped to enable the sheath to be slipped easily over the infill member and the assembly, but not easily removed therefrom.

7. The improvement of claim 1 wherein the infill member and the sheath are molded from plastic materials of different colors.

8. The improvement of claim 1 wherein the infill member is provided with a plurality of ribs to divide up the space between the infill member and the sheath.

9. The improvement of claim 1 wherein the infill member has a recess within which said attachment neons can move.

10. The improvement of claim 1 wherein the sheath has means to grip the infill member at each end thereof.

11. The improvement of claim 8 or 1 wherein the space between the infill member and the sheath is divided into a plurality of cells by ribs located on one side of the infill member.

12. The improvement of claim 1 or 5 wherein each at least one shank comprises a flat blade with an end which is inserted into a recess in the infill member and interlock means comprising an aperture in the shank which is fitted over a stud in the infill member to hold the shank and infill member securely together.

13. The improvement of claim 1 wherein a movable part is pivoted to the shank within the infill member.

14. The improvement of claim 5 wherein the tool is a scissor-like tool comprising a pair of blades pivoted to each other, and a pair of said improved handles, one on each shank of the tool.

* * * * *